US008117707B1

(12) United States Patent
Ruh, II

(10) Patent No.: US 8,117,707 B1
(45) Date of Patent: Feb. 21, 2012

(54) POOL CAGE BEAM BRUSH

(76) Inventor: Gary Robert Ruh, II, Port Charlotte, FL (US)

( * ) Notice: Subject to any disclaimer, the term of this patent is extended or adjusted under 35 U.S.C. 154(b) by 354 days.

(21) Appl. No.: 12/454,844

(22) Filed: May 26, 2009

(51) Int. Cl.
*A46B 9/02* (2006.01)
*A46B 15/00* (2006.01)

(52) U.S. Cl. ..... 15/160; 15/144.1; 15/172; 15/202; D4/120

(58) Field of Classification Search ..... 15/144.1, 15/160, 172, 176.1, 176.6, 202, 256.5, 256.6; D4/119, 120, 121; D28/63; D32/47
See application file for complete search history.

(56) References Cited

U.S. PATENT DOCUMENTS

| | | | | | |
|---|---|---|---|---|---|
| 328,426 | A | * | 10/1885 | Nowlin | 15/166 |
| 612,491 | A | * | 10/1898 | Eck | 15/111 |
| 725,843 | A | * | 4/1903 | Henn, Jr. | 15/160 |
| 1,092,014 | A | * | 3/1914 | Briggs | 15/172 |
| 2,226,634 | A | * | 12/1940 | Sabin | 118/208 |
| 2,331,516 | A | * | 10/1943 | Thompson | 118/208 |
| 2,408,555 | A | * | 10/1946 | Hart | 15/160 |
| 2,625,702 | A | * | 1/1953 | Grubbs | 15/160 |
| 2,821,736 | A | * | 2/1958 | Kasper | 15/394 |
| 3,398,421 | A | * | 8/1968 | Rashbaum | 15/167.1 |
| 4,827,555 | A | * | 5/1989 | Fruit et al. | 15/160 |
| 5,070,569 | A | * | 12/1991 | Wilkins | 15/160 |
| 5,313,687 | A | | 5/1994 | Schneider | |
| D350,424 | S | * | 9/1994 | Elliott | D32/40 |
| 5,502,859 | A | | 4/1996 | Kim | |
| D370,348 | S | * | 6/1996 | McElheney | D4/120 |
| 5,765,699 | A | | 6/1998 | Griffin | |
| 5,813,641 | A | | 9/1998 | Baldwin | |
| 5,842,249 | A | * | 12/1998 | Sato | 15/167.2 |
| 5,878,460 | A | * | 3/1999 | Bruce | 15/160 |
| 5,996,162 | A | * | 12/1999 | Hsu | 15/144.1 |
| 6,076,221 | A | | 6/2000 | Bradshaw | |
| 6,434,781 | B1 | * | 8/2002 | Guerra | 15/256.5 |
| 6,763,545 | B2 | * | 7/2004 | Silvers et al. | 15/106 |

* cited by examiner

*Primary Examiner* — Mark Spisich
(74) *Attorney, Agent, or Firm* — Richard L. Mikesell

(57) ABSTRACT

A brush device can be releasably attached to a distal end of a pool broom and has a plurality of strategically placed brushes which brushingly engage the surfaces of the beams of a pool cage to clean those surfaces. The brushes are mounted on a head that can be angularly adjusted so the brushes will engage the cage surfaces in a manner which is conducive to thorough cleaning of those surfaces. The brushes are releasably mounted so they can be removed for cleaning or replacement.

1 Claim, 1 Drawing Sheet

POOL CAGE BEAM BRUSH

TECHNICAL FIELD OF THE INVENTION

Figure 1:
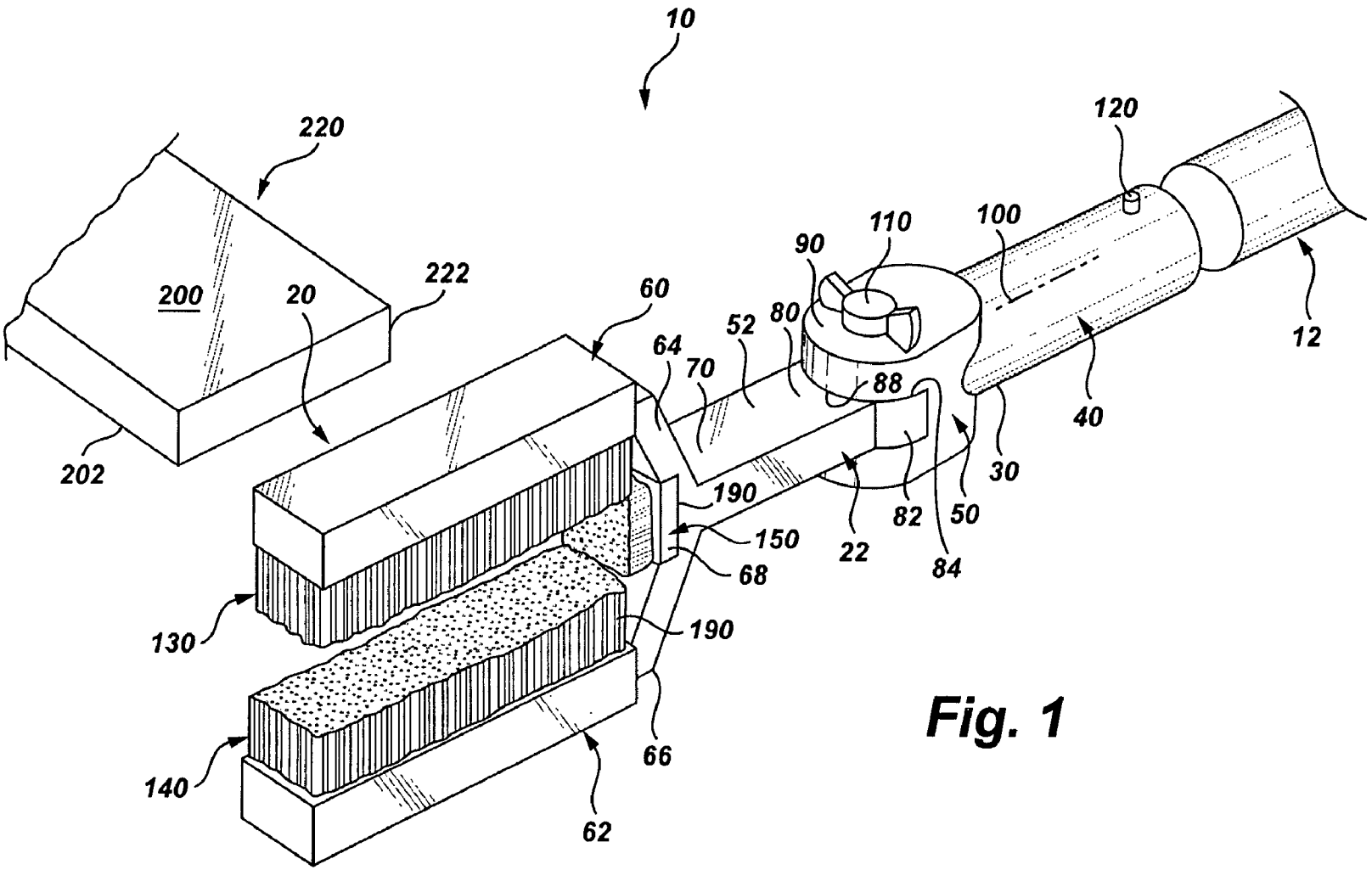

The present invention relates to the general art of cleaning and brushing, and to the particular field of cleaning implements for special applications.

BACKGROUND OF THE INVENTION

Many swimming pools are enclosed by a screened swimming pool cage which is structurally formed of box or rectangular section aluminum tubing. Screened swimming pool cages, lanai structures and the like are generally fabricated using rectangularly sectioned channel members formed of thin wall aluminum extrusions. These channel members include several surfaces and longitudinal spaced grooves on at least one surface, and typically on opposing surfaces which are coextensive with the channel member and are utilized primarily on an outwardly facing surface to supportively engage with screening enclosure material held in place with an elastomeric bead being forced into each groove with an edge of the screen material.

Such a screen enclosure typically includes a plurality of spaced upright channel members forming the wall structure and horizontally and angular disposed spaced channel members forming the top portion of the enclosure. The support structure formed by these channel members in this fashion is sufficient in strength to also be utilized to support various objects such as flower pots, equipment racks and brackets, lighting and stereo equipment, security system components and the like.

The inventor has found that the surfaces on such cages are subject to mildew as well as dirt collection. These surfaces must be periodically cleaned. Heretofore, the cleaning of these surfaces has required power washing, which, in turn, often requires a crew of several workers. The cleaning operation can be messy, expensive and time consuming if carried out by power washing. The power washing can also damage paint on the structure thereby requiring the owner to incur still further costs in both time and money to repaint damaged areas.

Therefore, there is a need for a means to efficiently and safely clean the surfaces of a swimming pool cage structure, and which can be carried out by the pool owner himself.

SUMMARY OF THE INVENTION

The above-discussed disadvantages of the prior art are overcome by a brush device that can be releasably attached to a distal end of a pool broom and has a plurality of strategically placed brushes which brushingly engage the surfaces of the beams of a pool cage to clean those surfaces. The brushes are mounted on a head that can be angularly adjusted so the brushes will engage the cage surfaces in a manner which is conducive to thorough cleaning of those surfaces. The brushes are releasably mounted so they can be removed for cleaning or replacement.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the different view.

FIG. 1 is a perspective view of a brush embodying the present invention.

DETAILED DESCRIPTION OF THE INVENTION

Referring to the FIGURE, it can be understood that the present invention is embodied in a brush implement 10 that can be releasably mounted on a distal end of a pool broom 12 for use in cleaning surfaces of beams used in a pool cage to prevent dirt, mildew and other undesired elements from building up on those surfaces.

Brush 10 includes a head section 20 connected at a proximal end 22 thereof to a distal end 30 of a support section 40 by a swivel joint 50. Head section 20 is Y-shaped and includes a base section 52 on which is mounted two spaced-apart legs 60 and 62. Legs 60 and 62 are attached to base section 52 by connecting sections 64 and 66 respectively and have a landing section 68 located therebetween adjacent to distal end 70 of the base section.

Base section 52 has a proximal end 80 which has a circular attachment section 82 thereon. Section 82 has a first surface 84 on which knurling or teeth (not visible in the FIGURE) are positioned for engagement with cooperative knurling or teeth (not visible in the FIGURE) on surface 88 of base section 90 of swivel joint 50. The knurling or teeth on the surfaces 84 and 88 cooperate with each other to hold head section 20 at a selected angle with respect to longitudinal axis 100 of support section 40. A clamp screw 110 clamps swivel joint section 90 to section 82 once the head section is in the desired orientation with respect to the support section 40.

Support section 40 is attached to pool broom 12 by a fastener 120 and hence the brush head section 20 is placed in a desired orientation with respect to the pool broom by the swivel clamp section 50 so the brush head section is in an orientation that will most efficiently clean the surfaces of the pool cage beams.

A plurality of brushes, 130, 140 and 150, are releasably mounted on inner surfaces of brush head section 20. Brushes 130 and 140 face each other to clean opposite sides 200 and 202 of a pool cage beam 220 located therebetween while brush 150 is located in landing section 68 to clean an end edge 222 of the beam while the brushes 130 and 140 clean opposite surfaces thereof. As can be understood from FIG. 1, the brushes are located in grooves, such as groove 190, defined in the brush head section so the brushes will be frictionally held in position on head section 20. The brushes can be slid into or out of the grooves for cleaning or replacement as necessary.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A brush for cleaning a pool cage beam having opposed surfaces and an edge surface between the opposed surfaces, the brush comprising:

a) a head section, the head section comprising first and second elongate support legs with the first and second support legs being substantially parallel to each other, an elongate base section, a pair of connection sections each coupling an end of a respective one of the support legs to a first end of the base section;

b) a support section having a first end pivotally coupled to a second end of the base section, the pivoting being about an axis generally parallel to a plane defined by the elongate support legs, the pivotal coupling including a fastener element for locking the base section and the support section in a selected angular relationship with each other, the support section further having a second end provided with means for attaching an elongate handle or pole thereto;

c) a plurality of brushes each removably mounted to the head section, the plurality of brushes including first and second elongate brushes located in facing relationship on respective inner surfaces of the first and second elongate support legs, and a third brush located adjacent the first end of the base section between the pair of connection sections and the first and second brushes on the support legs; and d) whereby the first and second brushes are adapted to clean the opposed surfaces of the beam while the third brush is engaged with the edge surface thereof.

* * * * *